US009502813B2

(12) United States Patent
Dugo

(10) Patent No.: US 9,502,813 B2
(45) Date of Patent: Nov. 22, 2016

(54) SUPPORTING FRAME CONSTRUCTION FOR MODULAR CONNECTORS

(71) Applicant: MOLEX HEAVY DUTY CONNECTOR GROUP S.R.L., San Donato Milanese (MI) (IT)

(72) Inventor: Mario Dugo, San Donato Milanese (IT)

(73) Assignee: MOLEX HEAVY DUTY CONNECTOR GROUP S.R.L., San Donato Milanese (MI) (IT)

( * ) Notice: Subject to any disclaimer, the term of this patent is extended or adjusted under 35 U.S.C. 154(b) by 0 days.

(21) Appl. No.: 14/780,537

(22) PCT Filed: Mar. 13, 2014

(86) PCT No.: PCT/IB2014/000352

§ 371 (c)(1),
(2) Date: Sep. 26, 2015

(87) PCT Pub. No.: WO2014/155171

PCT Pub. Date: Oct. 2, 2014

(65) Prior Publication Data

US 2016/0056567 A1 Feb. 25, 2016

(30) Foreign Application Priority Data

Mar. 27, 2013 (IT) ..... MI2013A0462

(51) Int. Cl.
*H01R 13/518* (2006.01)
*H01R 13/512* (2006.01)
(Continued)

(52) U.S. Cl.
CPC ..... *H01R 13/512* (2013.01); *H01R 9/2408* (2013.01); *H01R 13/502* (2013.01); *H01R 13/518* (2013.01)

(58) Field of Classification Search
CPC ..... H01R 9/2608; H01R 9/26; H01R 13/518
See application file for complete search history.

(56) References Cited

U.S. PATENT DOCUMENTS 3,576,520 A * 4/1971 Stauffer ..... H01R 9/26 257/724
5,595,507 A * 1/1997 Braun ..... H01R 4/64 439/716

(Continued)

FOREIGN PATENT DOCUMENTS

GB 1459491 A 12/1976
NL 7400236 A 7/1974

(Continued)

OTHER PUBLICATIONS

Notification of Transmittal of the International Search Report and the Written Opinion of the International Searching Authority dated Jun. 17, 2014.

*Primary Examiner* — Gary Paumen
(74) *Attorney, Agent, or Firm* — Hedman & Costigan, P.C.; James V. Costigan; Kathleen A. Costigan

(57) ABSTRACT

A supporting frame construction for modular connectors comprises a main structural element associated by sliding engagement means with a linear element; said main structural element including a linear portion having a plurality of seats for engaging therein a plurality of corresponding projections formed on modules to be mounted in the supporting frame construction; said linear element including a plurality of linear element seats, corresponding to the seats of the linear portion of the main structural element, for engaging therein corresponding projections formed on said modules.

4 Claims, 5 Drawing Sheets

(51) Int. Cl.
*H01R 9/24* (2006.01)
*H01R 13/502* (2006.01)

(56) References Cited

U.S. PATENT DOCUMENTS 5,989,062 A * 11/1999 Daoud ..... H01R 13/518 439/532
6,004,162 A * 12/1999 Harting ..... H01R 13/518 439/532
6,196,869 B1 * 3/2001 Kay ..... H01R 9/2441 439/532
7,316,591 B2 * 1/2008 Ferderer ..... H01R 13/518 439/532
7,979,985 B2 * 7/2011 Spitaels ..... H01R 13/741 29/876
2010/0068922 A1 3/2010 Zhou et al.
2012/0295475 A1 * 11/2012 Fasce ..... H04Q 1/06 439/532

FOREIGN PATENT DOCUMENTS

WO 2008154626 A2 12/2008
WO 2013013016 A1 1/2013

* cited by examiner

SUPPORTING FRAME CONSTRUCTION FOR MODULAR CONNECTORS

BACKGROUND OF THE INVENTION

The present invention relates to a supporting frame construction for modular connectors.

As is known, in the industrial electric wiring field modular connectors, which are usually mounted in a supporting frame, are conventionally used, designed to receive multiple different connectors engageable in frame seats for engaging therein projections formed on said connectors or "fruit" components.

Prior supporting frames generally comprise two U-shaped portions coupled to one another by threaded or screw connections.

The assembling of the frame in conventional frame constructions is a comparatively complex operation.

A further drawback is that a proper engaging and disengaging of the electric "fruit" elements in prior supporting frames for replacement purposes is a rather difficult task.

SUMMARY OF THE INVENTION

Accordingly, the aim of the present invention is to provide a supporting frame construction for modular connectors which can be easily installed and in which the "fruit" elements may be also easily engaged and removed for replacement.

Within the scope of the above mentioned aim, a main object of the invention is to provide such a supporting frame construction which may be easily and quickly made starting from available elements and materials and which, moreover, is very competitive from a mere economic standpoint.

Another object of the present invention is to provide such a supporting frame construction which is very reliable and safe in operation.

According to one aspect of the present invention, the above mentioned aim and objects, as well as yet other objects, which will become more apparent hereinafter, are achieved by a supporting frame construction for modular connectors, characterized in that said supporting frame construction comprises a main structural element associated by sliding engagement means with a linear element.

The main structural element comprises a linear portion including a plurality of seats, wherein corresponding projections of modules to be applied to the frame structure may be engaged.

The linear element comprises a plurality of linear element seats, corresponding to the seats of the main structural element linear portion, for engaging therein corresponding projections of the modules to be applied to the frame construction.

The linear element has at least two operating positions: an engagement position, in which said linear element is rigidly connected to the main structural element and said seats engage the module projections, thereby locking said modules in the frame, and a displaced or offset position in which said linear element seats are disengaged from the module projections, thereby allowing the modules to be easily and quickly removed from the supporting frame.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of an indicative but not limitative example, in the accompanying drawings, where.

DESCRIPTION OF THE PREFERRED EMBODIMENTS

Figure 1:
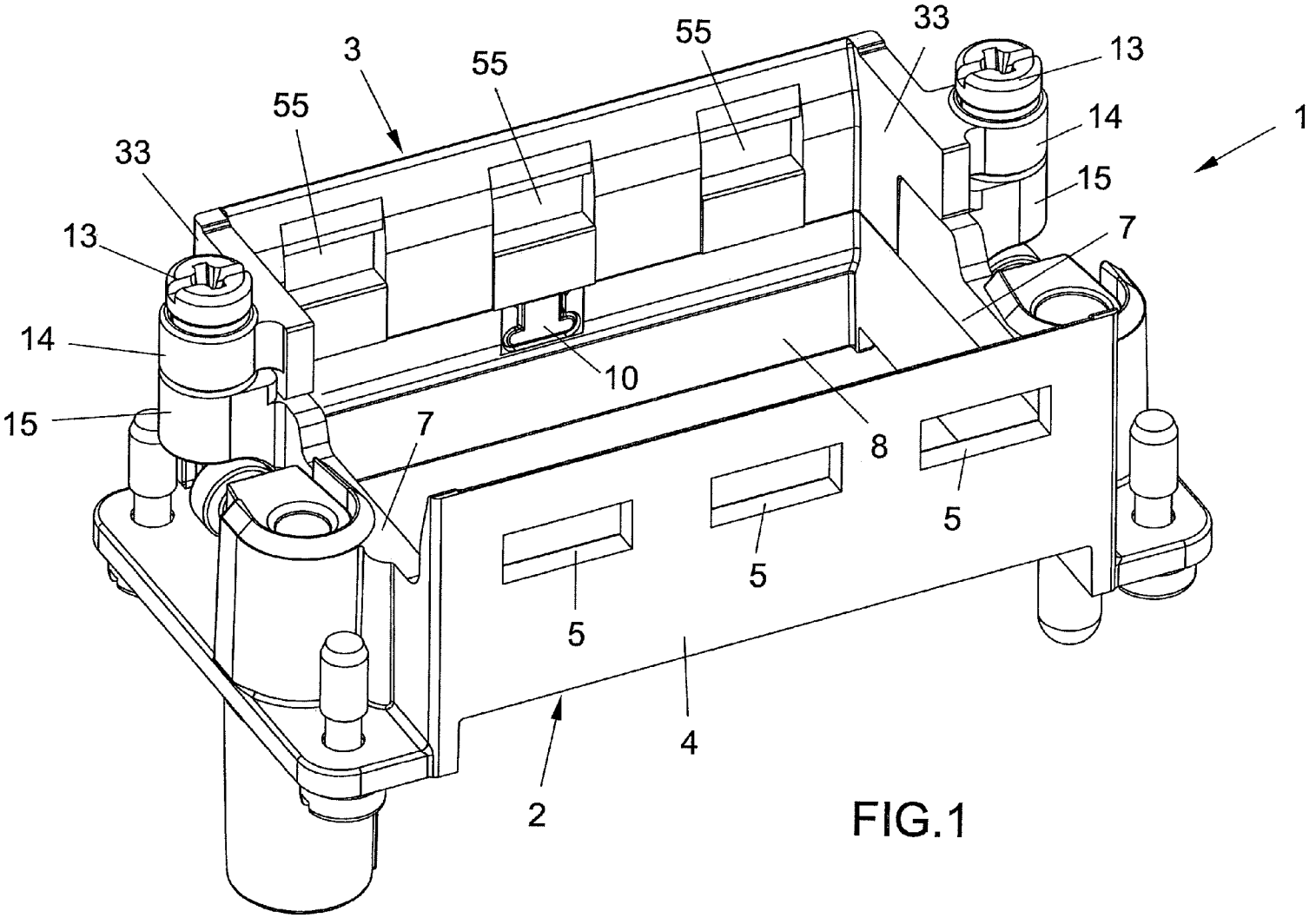
FIG. 1 is a perspective view of the modular connector supporting frame construction according to the present invention.
Figure 2:
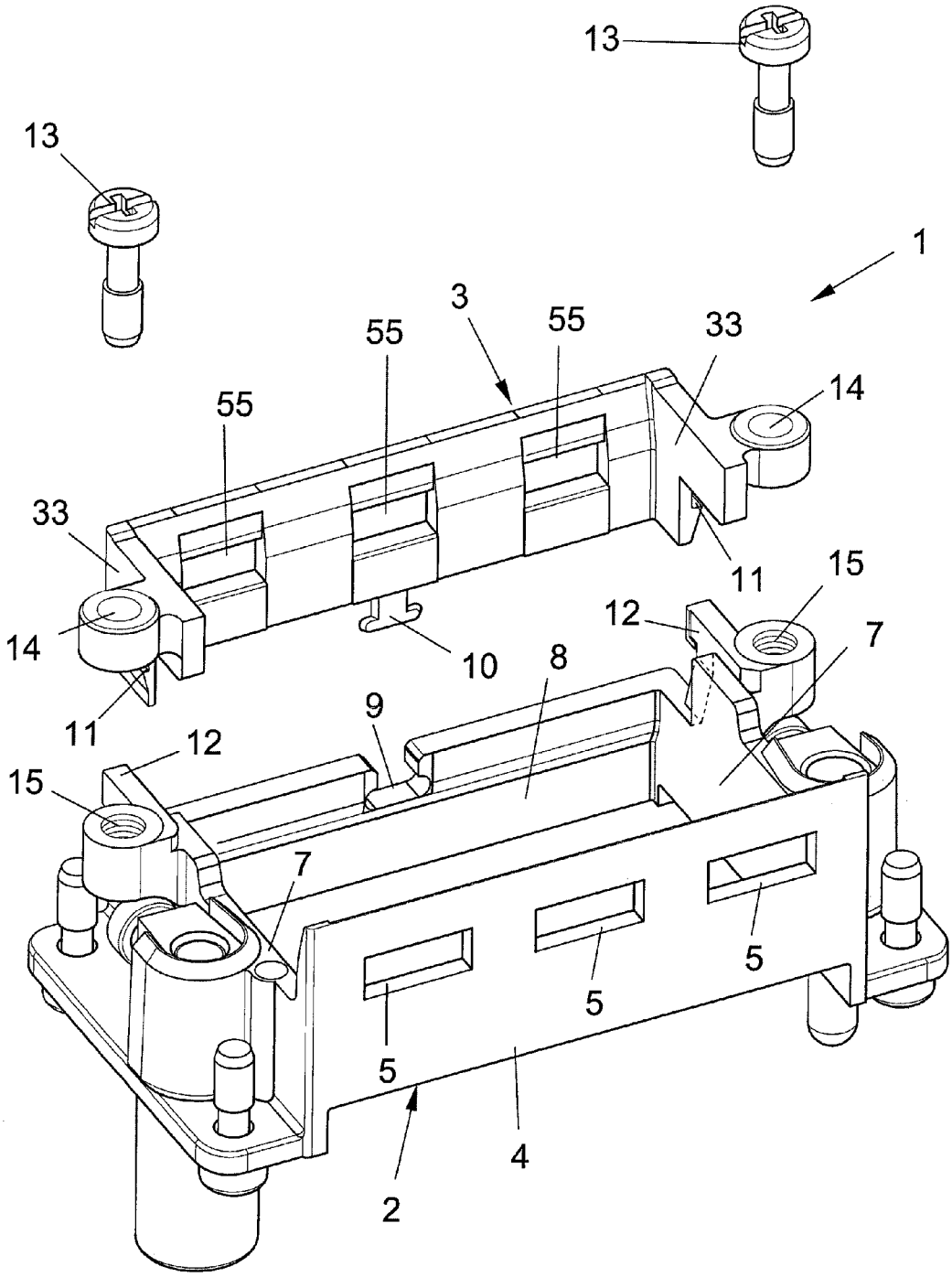
FIG. 2 is a further exploded perspective view showing the inventive supporting frame construction.
Figure 3:
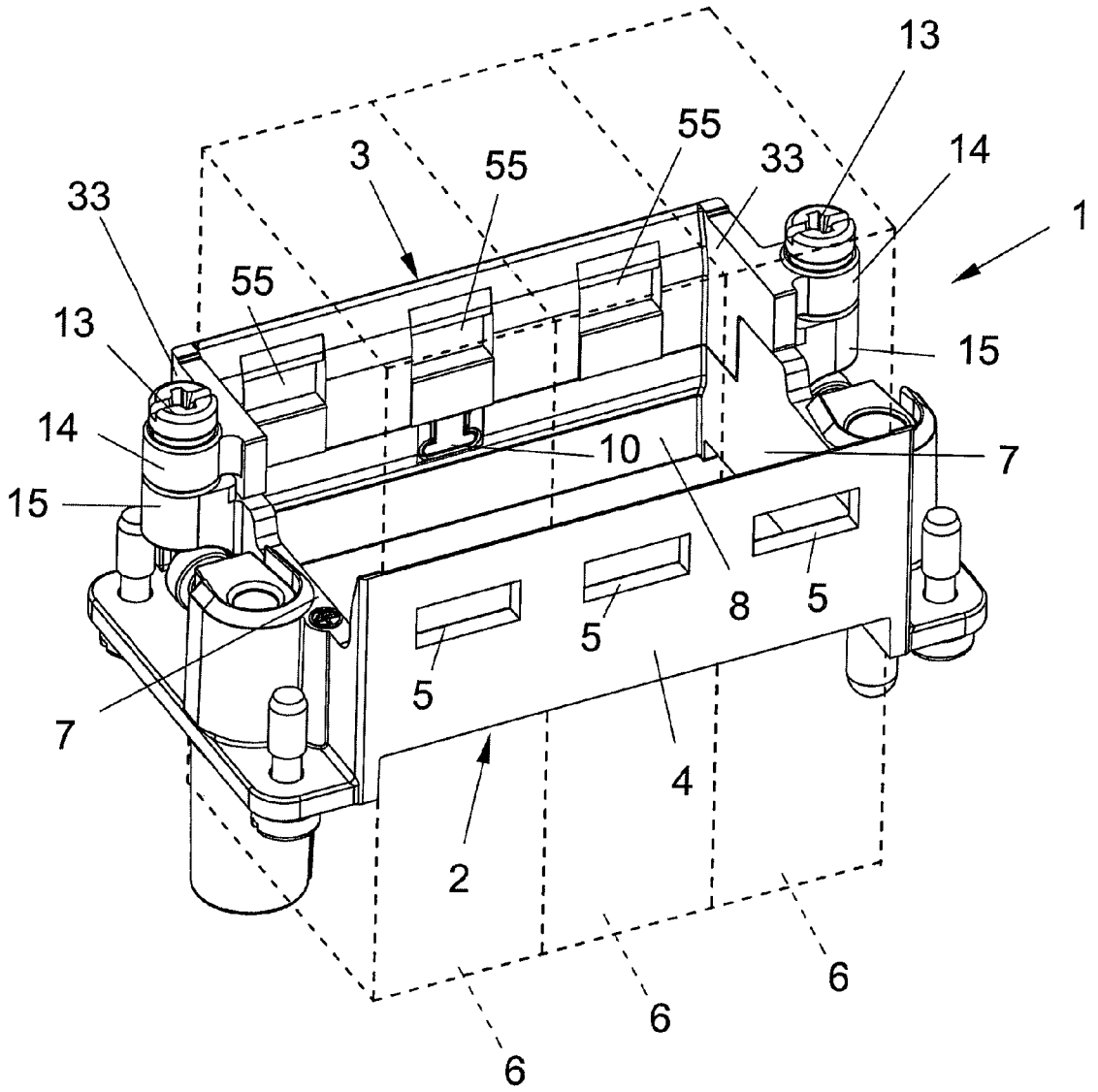
FIG. 3 is yet another perspective view showing, by dashed lines, some modular components engaged in the supporting frame construction.
Figure 4:
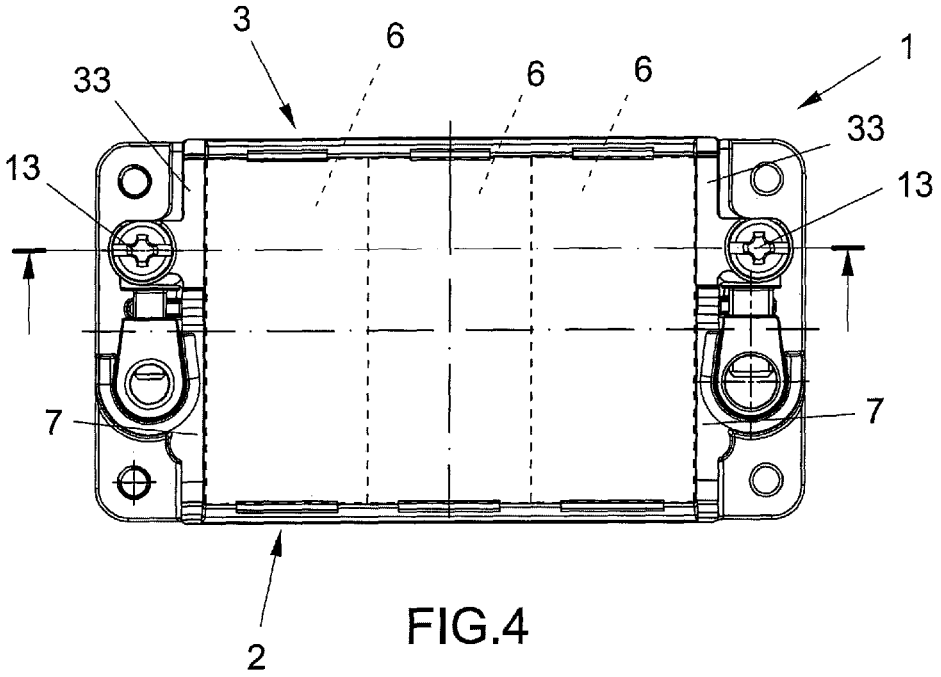
FIG. 4 is a top plan view of the supporting frame construction.
Figure 5:
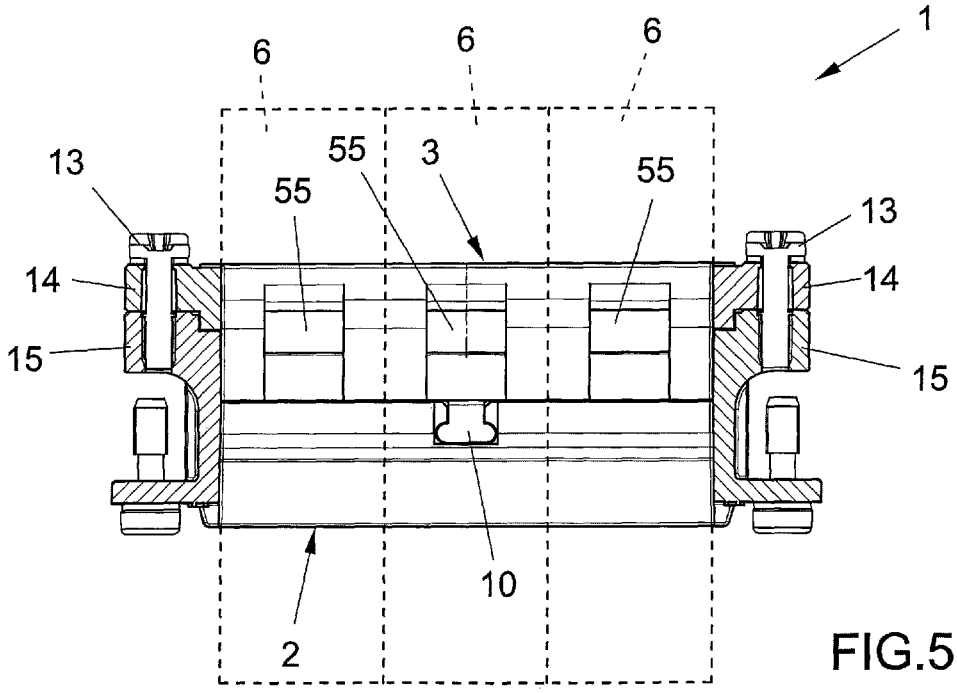
FIG. 5 is a front elevation view, as cross-sectioned according to the section plane V-V of FIG. 4.
Figure 6:
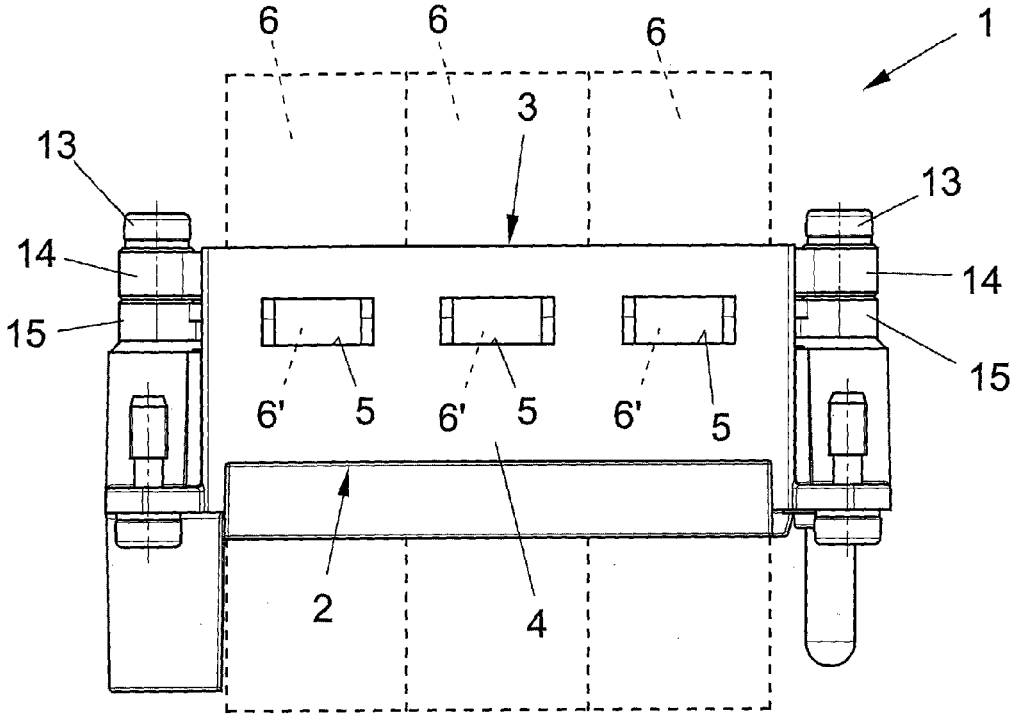
FIG. 6 is another front elevation view of the supporting frame construction.
Figure 7:
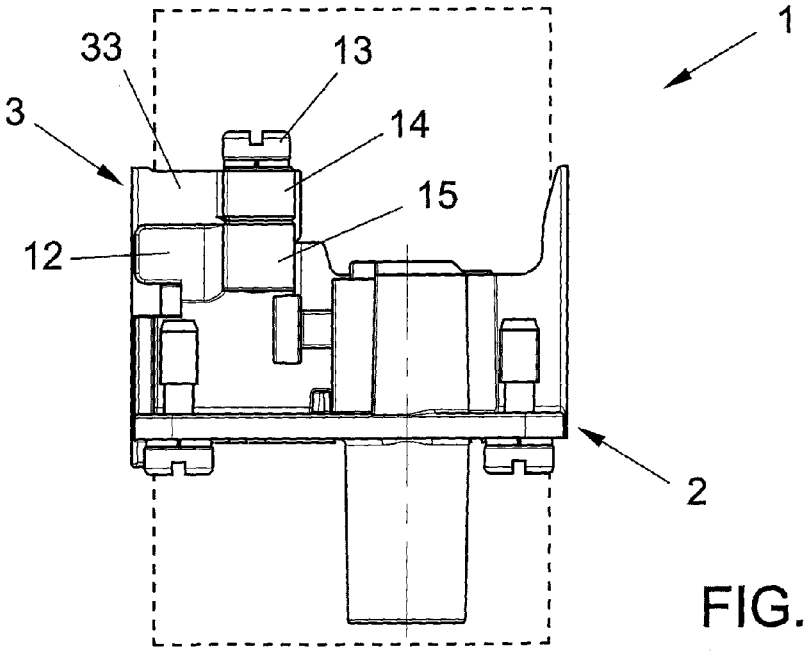
FIG. 7 is a side elevation view of the subject supporting frame construction.

With reference to the number references of the above mentioned figures, the supporting frame construction for modular connectors according to the present invention, which has been generally indicated by the reference number 1, comprises a main structural element 2, associated, by sliding engagement means, with a linear element 3.

Said main structural element 2 comprises a linear portion 4, including a plurality of linear portion seats or recesses 5, for engaging therein suitable projections, not shown in the drawings, formed on the modules 6 to be mounted in the supporting frame construction 1.

Said main structural element 2 comprises two cross members 7, supporting a bar or rod element 8 arranged parallel to the linear portion 4.

Said bar or rod element 8 comprises a shaped seat or recess 9, for engaging therein a corresponding shaped lug 10, formed on the linear element 3.

Said linear element 3 comprises a corresponding plurality of seats or recesses 55, corresponding to said seats 5 of the linear portion 4 of the main structural element 2, for engaging therein corresponding projections, not shown in the drawings, formed on said modules 6.

Said sliding engagement means for associating the linear element 3 to the main structural element 2, to form the frame construction 1, are advantageously constituted by longitudinal recesses 11, formed on respective sides 33 of the linear element 3, and adapted to engage corresponding longitudinal lugs 12 formed on the cross members 7 of the main structural element 2.

The linear element 3 is clamped on the main structural element 2 by a pair of clamping screws 13 threaded in respective eyelets 14 formed on the linear element 3 and respective ring-nuts 15 formed in the cross members 7 of the main structural element 2.

The assembling of the modular connector according to the present invention is very easy and quick since it is sufficient to insert the modules 6 into the main structural element 2 and then drive the linear element 3 to slide to its engagement position, and then clamp it by the clamping screws 13.

The disassembling of the connector, when required, is in turn very simple, since it is sufficient to unscrew the screws 13 and cause the linear element 3 to slide for a length allowing the projection of the module 6 to be disengaged from the seat 55 thereby withdrawing the module without the need of disassembling the overall construction.

It has been found that the invention fully achieves the intended aim and objects.

In fact, the invention has provided a supporting frame construction consisting of a main structural element and a linear element comprising at least two operating positions: an engagement position, in which it is rigidly connected to the main structural element and in which said seats engage the module projections, thereby locking the latter in the frame, and an offset position, in which the seats of the linear element disengage the module projections thereby facilitating the frame removal.

Moreover, it should be pointed out that the main structural element is made as a single piece thereby providing the frame construction with a maximum stability.

In practicing the invention, the used materials, as well as the contingent size and shapes can be any, depending on requirements.

The invention claimed is:

1. A supporting frame construction for modular connectors, said construction comprising a main structural element (2) associated by sliding engagement means with a linear element (3); said main structural element (2) including a linear portion (4) including a plurality of seats (5) for engaging therein a plurality of corresponding projections formed on modules (6) to be mounted in the supporting frame construction (1); said linear element (3) including a plurality of linear element seats (55), corresponding to the seats (5) of the linear portion of the main structural element (2), for engaging therein corresponding projections formed on said modules (6) to be mounted in the frame construction (1), said linear element (3) comprising at least two operating positions: an engagement position, in which said main structural element (2) is rigidly connected and said seats engage the projections of said modules (6) to lock said modules in said frame (1), and an offset position in which the seats (55) of the linear element (3) disengage the projections of the modules (6) thereby facilitating a removal of said frame (1), said main structural element (2) comprising two cross members (7) supporting a rod element (8) parallel to the linear element (3), said rod element (8) comprising a shaped seat (9) with which a shaped lug (10) formed on the linear element (3) can be engaged, said linear element (3) comprising a plurality of seats (55) corresponding to the seats (5) of the linear portion (4) of the main structural element (2), for engaging therein corresponding projections formed on said modules (6), characterized in that said sliding engagement means, for associating the linear element (3) with the main structural element (2) to provide the frame construction (1), comprise longitudinal recesses (11) formed on respective sides (33) of the linear element (3) for engaging corresponding longitudinal lugs (12) formed on the cross members (7) of the main structural element (2).

2. A supporting frame construction, according to claim 1, characterized in that said linear element (3) is clamped on the main structural element (2) by a pair of clamping screws (13) threaded in respective eyelets (14) formed on the linear element (3), and respective screw-nuts (15) formed in the cross members (7) of the main structural element (2).

3. A supporting frame construction, according to claim 2, characterized in that said construction allows to insert the modules (6) in the main structural element (2) and cause the linear element (3) to slide to an engagement position while locking said linear element (3) to the main structure element (2) at an end of stroke position by said clamping screws (13).

4. A supporting frame construction, according to claim 1, characterized in that said main structural element (2) is made as a single piece.

* * * * *